US009765537B2

(12) United States Patent
Miousse et al.

(10) Patent No.: US 9,765,537 B2
(45) Date of Patent: Sep. 19, 2017

(54) VERTICAL SUPPORT MEMBER FOR A SUSPENDED SCAFFOLD ASSEMBLY, KIT FOR MOUNTING A SUSPENDED SCAFFOLD ASSEMBLY, SUSPENDED SCAFFOLD ASSEMBLY AND METHOD FOR MOUNTING THE SAME

(71) Applicant: 9020-4983 Quebec, Inc., Saguenay (CA)

(72) Inventors: Richard Miousse, Saguenay (CA); Luc Beland, Saguenay (CA)

(73) Assignee: 9020-4983 Quebec Inc., Saguenay (Quebec) (CA)

( * ) Notice: Subject to any disclaimer, the term of this patent is extended or adjusted under 35 U.S.C. 154(b) by 0 days.

(21) Appl. No.: 14/319,459

(22) Filed: Jun. 30, 2014

(65) Prior Publication Data

US 2015/0068841 A1 Mar. 12, 2015

Related U.S. Application Data

(60) Provisional application No. 61/875,880, filed on Sep. 10, 2013.

(51) Int. Cl.

| | |
|---|---|
| ***E04G 5/04*** | (2006.01) |
| ***E04G 3/30*** | (2006.01) |
| ***E04G 7/20*** | (2006.01) |

(52) U.S. Cl.

CPC ..... *E04G 5/04* (2013.01); *E04G 3/30* (2013.01); *E04G 7/20* (2013.01)

(58) Field of Classification Search

CPC .... E04G 5/04; E04G 5/00; E04G 3/30; E04G 3/305; E04G 3/32; E04G 3/00;

(Continued)

(56) References Cited

U.S. PATENT DOCUMENTS 2,376,955 A * 5/1945 Ball ..... A47B 81/005 211/60.1
3,776,368 A * 12/1973 Brauss ..... B66D 1/54 182/112

(Continued)

FOREIGN PATENT DOCUMENTS

| | | |
|---|---|---|
| CA | 2737715 A1 | 10/2011 |
| CA | 2777077 A1 | 11/2012 |
| CA | 2830271 A1 | 4/2014 |

OTHER PUBLICATIONS

Layher, "Scaffold ring (rosette) with 8 connections", Aug. 16, 2013, http://www.layher.com.au/scaffold-ring-system.html.

*Primary Examiner* — Colleen M Chavchavadze
*Assistant Examiner* — Shiref Mekhaeil
(74) *Attorney, Agent, or Firm* — Price Heneveld LLP

(57) ABSTRACT

A suspended scaffold assembly for mounting a scaffold. The suspended scaffold assembly comprises a plurality of horizontally-spaced-apart vertical support members comprising a suspension cable with at least one coupling ring secured thereto and at least one horizontal member. Each one of the at least one horizontal member is removably connectable to a respective one of the at least one coupling ring of two spaced-apart ones of the plurality of vertical support members. A vertical support member for a suspended scaffold assembly, a kit for mounting a suspended scaffold assembly and a method for mounting same are also provided.

17 Claims, 5 Drawing Sheets

(58) Field of Classification Search
CPC .... E04G 7/20; E04G 7/06; E04G 7/22; E04B 9/18; E04B 9/183
See application file for complete search history.

(56) References Cited

U.S. PATENT DOCUMENTS 3,788,489 A * 1/1974 Levinthal ..... A47F 5/04 211/163
4,044,523 A * 8/1977 Layher ..... E04G 7/307 182/186.8
4,294,393 A * 10/1981 Weld ..... B60B 1/00 228/134
4,441,583 A * 4/1984 Vaught ..... E04G 3/22 182/150
4,493,578 A * 1/1985 D'Alessio ..... E04G 7/307 182/186.8
4,587,786 A * 5/1986 Woods ..... E04G 7/307 182/186.8
4,688,685 A * 8/1987 Brace ..... A63C 11/028 211/60.1
4,840,513 A * 6/1989 Hackett ..... E04G 7/307 182/186.8
4,981,196 A * 1/1991 Palm ..... E04G 3/30 182/112
5,098,143 A * 3/1992 Hill ..... B66C 1/122 294/67.41
5,207,527 A * 5/1993 Duncan ..... E04G 7/307 182/186.8
5,560,730 A * 10/1996 Gillard ..... E04G 1/02 182/186.7
5,961,240 A * 10/1999 Bobrovniczky ..... E04G 7/307 182/186.8
7,258,316 B2 * 8/2007 Reeves ..... E04G 21/3261 248/231.91
8,303,207 B2 * 11/2012 Thacker ..... E04G 7/307 182/186.8
8,839,591 B2 * 9/2014 Guthrie ..... E04G 21/3276 248/231.9
8,978,822 B2 * 3/2015 Kreller ..... E04G 1/14 182/113
8,985,351 B1 * 3/2015 Longo ..... A47F 3/0404 211/13.1
9,051,746 B2 * 6/2015 Rogers ..... E04G 5/08
9,109,370 B2 * 8/2015 Kreller ..... E04G 7/20
2004/0020138 A1 * 2/2004 Grearson ..... E01D 19/106 52/64
2004/0178706 A1 * 9/2004 D' Orso ..... A47B 61/04 312/351
2006/0016638 A1 * 1/2006 Gluchowski ..... E04G 3/30 182/150
2006/0146547 A1 * 7/2006 Wu ..... F21V 21/03 362/405
2009/0056267 A1 * 3/2009 Reeves ..... A62B 1/04 52/699
2010/0018802 A1 * 1/2010 Sani ..... E04G 3/30 182/142
2012/0051879 A1 * 3/2012 Davis ..... B66C 13/08 414/729
2015/0023726 A1 * 1/2015 Thacker ..... E04G 7/307 403/49

* cited by examiner

VERTICAL SUPPORT MEMBER FOR A SUSPENDED SCAFFOLD ASSEMBLY, KIT FOR MOUNTING A SUSPENDED SCAFFOLD ASSEMBLY, SUSPENDED SCAFFOLD ASSEMBLY AND METHOD FOR MOUNTING THE SAME

CROSS REFERENCE TO RELATED APPLICATION

This application claims the benefit under 35 U.S.C. §119 (e) of U.S. provisional patent application No. 61/875,880 which was filed on Sep. 10, 2013. The entirety of the aforementioned application is herein incorporated by reference.

FIELD OF THE INVENTION

The present invention relates to the field of scaffolds. More particularly, it relates to a vertical support member for a suspended scaffold assembly, to a suspended scaffold assembly comprising the same, to a kit for mounting a suspended scaffold assembly and to a method for mounting a suspended scaffold assembly having such vertical support members.

BACKGROUND

It is known in the art to build ground supported scaffolds by coupling horizontal tubes to vertical tubes using coupling components. When erected, scaffolds provide a solid construction, supported by the ground, upon which one can work in order to carry heavy loads or erect multiple horizontal platforms in order to build other constructions and/or to work on said constructions, for example and without being limitative, during renovations, repair works or the like.

In the prior art, solutions for coupling the horizontal tubes to the vertical tubes include using vertical tubes provided with coupling rings, such as rosettes, and horizontal tubes, such as ledgers and guardrails, having a combination of a vertical and a horizontal slot for removably coupling the horizontal tubes to the coupling rings. Diagonal braces are commonly also provided to result in a sturdier assembly of the horizontal and vertical tubes and planks, platform units and/or other footing components are usually laid onto the ledgers to provide a stable support for users to step onto.

Drawbacks of known conventional scaffold assemblies include the vertical tubes being heavy and cumbersome to handle when mounting the ground supported scaffolds. Moreover, known scaffold assemblies are designed to be mounted from the bottom up, i.e. multiple story scaffolds are designed to be mounted incrementally by mounting each scaffold story on top of one another. Therefore, it will be understood that ground supported scaffold assemblies are generally not adapted for worksites where mounting of the scaffold from the top down are desirable and/or required.

In view of the above, there is a need for improved vertical support members for a suspended scaffold assembly, an improved suspended scaffold assembly including such vertical support members, a kit for mounting a suspended scaffold assembly and a method for mounting same which would be able to overcome or at least minimize some of the above-discussed prior art concerns.

SUMMARY OF THE INVENTION

According to a first general aspect, there is provided a suspended scaffold assembly for mounting a scaffold. The suspended scaffold assembly comprises a plurality of horizontally-spaced-apart vertical support members comprising a suspension cable with at least one coupling ring secured thereto and at least one horizontal member. Each one of the at least one horizontal member is removably connectable to a respective one of the at least one coupling ring of two spaced-apart ones of the plurality of vertical support members.

In an embodiment, each one of the at least one coupling ring mounted to the suspension cable of each one of the plurality of vertical support members comprises a central aperture with the suspension cable extending therethrough. Each one of the plurality of vertical support members further comprises at least one coupling ring support coupled with each one of the at least one coupling ring and affixed to the suspension cable. The at least one coupling ring support maintains the respective one of the at least one coupling ring vertically in place.

In an embodiment, each one of the at least one coupling ring of each one of the plurality of vertical support members comprises a surrounding ring portion with a set of radially arranged engagement through holes.

In an embodiment, the suspension cable of each one of the plurality of vertical support members comprises at least one connecting loop at an end thereof.

In an embodiment, at least one of the plurality of vertical support members further comprises a connecting hook engaged with an upper one of the at least one connecting loop.

In an embodiment, the suspended scaffold assembly comprises at least one vertical support member assembly. Each one of the at least one vertical support member assembly comprises at least two vertical support members engaged together in a cascade configuration.

According to another aspect, there is also provided a vertical support member of a suspended scaffold assembly for mounting a scaffold. The vertical support member comprises a suspension cable, at least one connecting portion at an end of the suspension cable and at least one coupling ring secured vertically along the suspension cable.

In an embodiment, the suspension cable comprises a flexible cable.

In an embodiment, the least one coupling ring is rotatably mounted about the suspension cable.

According to another aspect, there is also provided, a kit for mounting a suspended scaffold assembly. The kit comprises a plurality of vertical support members. Each one of the vertical support members comprises a suspension cable with at least one coupling ring secured thereto. The kit also comprises at least one horizontal member having two distal ends removably connectable to a respective one of the at least one coupling ring of a corresponding one of the plurality of vertical support members.

In an embodiment, the kit further comprises a plurality of adapters having a horizontal support engaging section engageable with a section of a substantially horizontally extending suspension scaffold support and a vertical support engaging section engageable with a corresponding one of the plurality of vertical support members.

In an embodiment, at least two of the plurality of vertical support members are engageable in a cascade configuration to define a vertical support member assembly.

According to another general aspect, there is also provided a method for mounting a suspended scaffold assembly. The method comprises the steps of: suspending a plurality of spaced-apart vertical support members from a suspension scaffold support, each one of the plurality of horizontally spaced-apart vertical support members including at least one coupling ring secured thereto; and connecting at least one horizontal member having two opposed ends between at least two of the plurality of horizontally spaced-apart vertical support members, each one of the two opposed ends of the at least one horizontal member being connected to one of the at least one coupling ring of respective ones of the plurality of vertical support members.

In an embodiment, the method further comprises the steps of engaging adapters with the suspension scaffold support and engaging each one of the plurality of spaced-apart vertical support members with a corresponding one of the adapters.

In an embodiment, the method further comprises the step of engaging at least one vertical support member with at least one of the plurality of spaced-apart vertical support members engaged with the suspension scaffold support, to suspend at least two consecutive ones of the vertical support members in a cascade configuration.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are preferred embodiments only, given solely for exemplification purposes.

Moreover, although the embodiments of the vertical support member of the suspended scaffold assembly and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the vertical support member of the suspended scaffold assembly, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
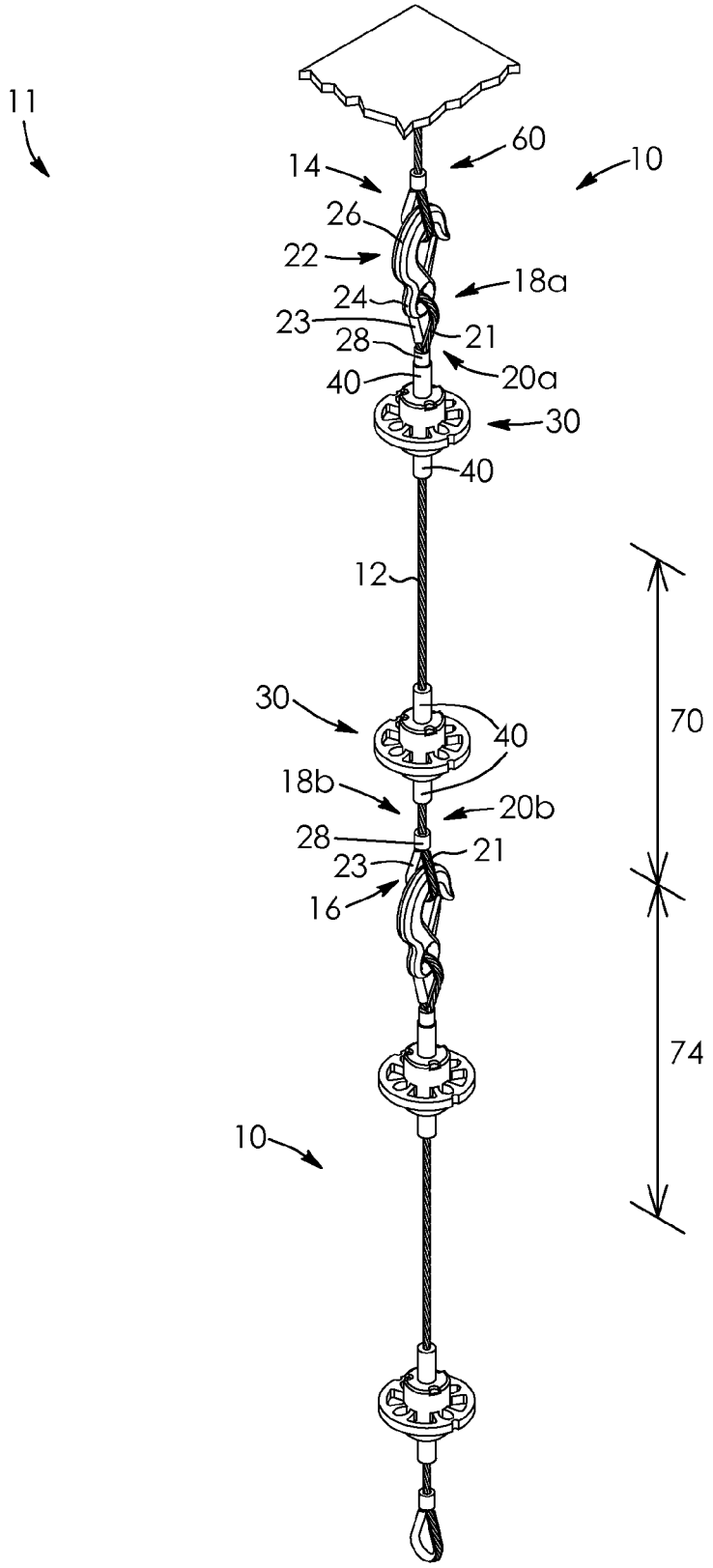
FIG. 1 is a perspective view of a vertical support member assembly with two vertical support members, in accordance with an embodiment.

Referring generally to FIG. 1, in accordance with an embodiment, there is shown a vertical support member assembly 11 for erecting a scaffold unit as will be described in more details below. The vertical support member assembly 11 comprises two vertical support members including a flexible supporting cable 12. The vertical support member 10 extends vertically between an upper end 14 and a lower end 16 thereof, with at least one coupling ring 30 mounted along the suspension cable 12, between the upper end 14 and the lower end 16. As will be understood by one skilled in the art, in the context of the present document, the term "flexible" is used to describe a support member 10 which is bendable and which may consequently adapt to different configurations of a suspended scaffold unit where diverse horizontal members may be connected between adjacent vertical support members 10.

In the embodiment shown, the supporting cable 12 is a steel wire rope having a diameter of about between ⅜ inch and ½ inch. However, one skilled in the art will understand that other types of cables, materials and diameters which result in a flexible cable offering sufficient durability and tensile strength can be used.

In the embodiment shown, the upper end 14 of the vertical support member 10 defines an upper connecting portion 18*a* configured to allow connection of the vertical support member 10 to a suspension scaffold support 60, such as, without being limitative, a ledger, outrigger beam, cornice hook, parapet clamp or the like, in a suspended configuration. The lower end 16 of the vertical support member 10 defines a lower connecting portion 18*b* in order to allow another vertical support member 10 to be suspended therefrom. Therefore, it will be understood that, as shown in the embodiment of FIG. 1, multiple vertical suspended members 10 can be suspended in a cascade configuration, i.e. the upper connecting portion 18*a* of each additional vertically-adjacent vertical suspended member 10 being suspended from the lower connecting portion 18*b* of the vertical support member 10 positioned above, to form a vertical support member assembly 11. One skilled in the art will however understand that, in an embodiment, the vertical support member 10 can be used independently, without being part of a vertical support member assembly 11.

One skilled in the art will also understand that, in an alternative embodiment, only the upper end 14 of a vertical support member 10 can define an upper connecting portion 18*a*, i.e. no lower connecting portion 18*b* is provided at the lower end 16 thereof. In such an embodiment, the vertical support member 10 can only be connected to the upward suspension scaffold support 60, in the suspended configuration. No additional vertical support members 10 can be suspended therefrom in the above-described cascade configuration.

Still referring to FIG. 1, in the embodiment shown, the upper connecting portion 18*a* of each vertical support member 10 includes an upper connecting loop 20*a*, defined by the section of suspension cable 12 extending above an upper coupling ring (i.e. the coupling ring 30 closest to the upper end 14 of the vertical support member 10), and a connecting hook 22 engaged with the upper connecting loop 20*a*. The lower connecting portion 18*b* located at the lower end 16 only includes a lower connecting loop 20*b*, defined by the section of suspension cable 12 extending below a lower coupling ring (i.e. the coupling ring 30 closest to the lower end 16 of the vertical support member 10). Such a configuration allows the above-described cascade configuration of multiple vertical support members 10, i.e. a first vertical support member 10 can be suspended from an upper and vertically-adjacent suspension scaffold support 60, via the connecting hook 22, with a second vertically adjacent vertical support member 10 being suspended from the first vertical support member 10 by engaging the connecting hook 22 of the second vertical support member 10 with the lower connecting loop 20*b* of the first vertical support member 10 to form the vertical support member assembly 11, as described above. Similarly, supplemental vertical support members 10 may be suspended from any vertical support member 10 located above, in order to reach a desired vertical height of the vertical support member assembly, and the corresponding suspended scaffold unit formed therewith, as will be better described below. One skilled in the art will understand that, in an alternative embodiment, a connecting hook 22 can also be coupled to the lower connecting loop 20*b*.

In the embodiment shown, each one of the upper connecting loop 20*a* and the lower connecting loop 20*b* includes a looped section 21 where the cable 12 is looped and joined to itself. In the embodiment shown, the looped section 21 surrounds a cable thimble 23. In an embodiment, the looped section 21 is formed by joining portions of the suspension cable 12 using a fixation member 28, such as a cable ferrule, to maintain the portions of the suspension cable 12 engaged together by friction. One skilled in the art will understand that, in alternative embodiments, other known methods or components for joining the portions of the suspension cable 12 may be used, to form the looped section 21.

In the embodiment shown, the connecting hook 22 engaged with the upper connecting loop 20*a* comprises a through hole in a lower portion 24 for receiving the cable 12 of the upper connecting loop 20*a* therethrough and securing the connecting hook 22 to the upper connecting loop 20*a*. The connecting hook 22 also has a hook shaped upper section, which can be referred to as the "hook portion" 26. One skilled in the art will understand that, even though the lower portion 24 of the hook 22 and the hook portion 26 are integral in the embodiment shown, in an alternative embodiment, the lower portion 24 can be fixedly or removably mounted to the hook portion 26 through known connecting means, such as and without being limitative, welding, soldering, riveting, or the like. In an embodiment, the lower portion 24 of the hook 22 and the hook portion 26 can also be pivotally mounted through known connecting means or methods.

Figure 4:
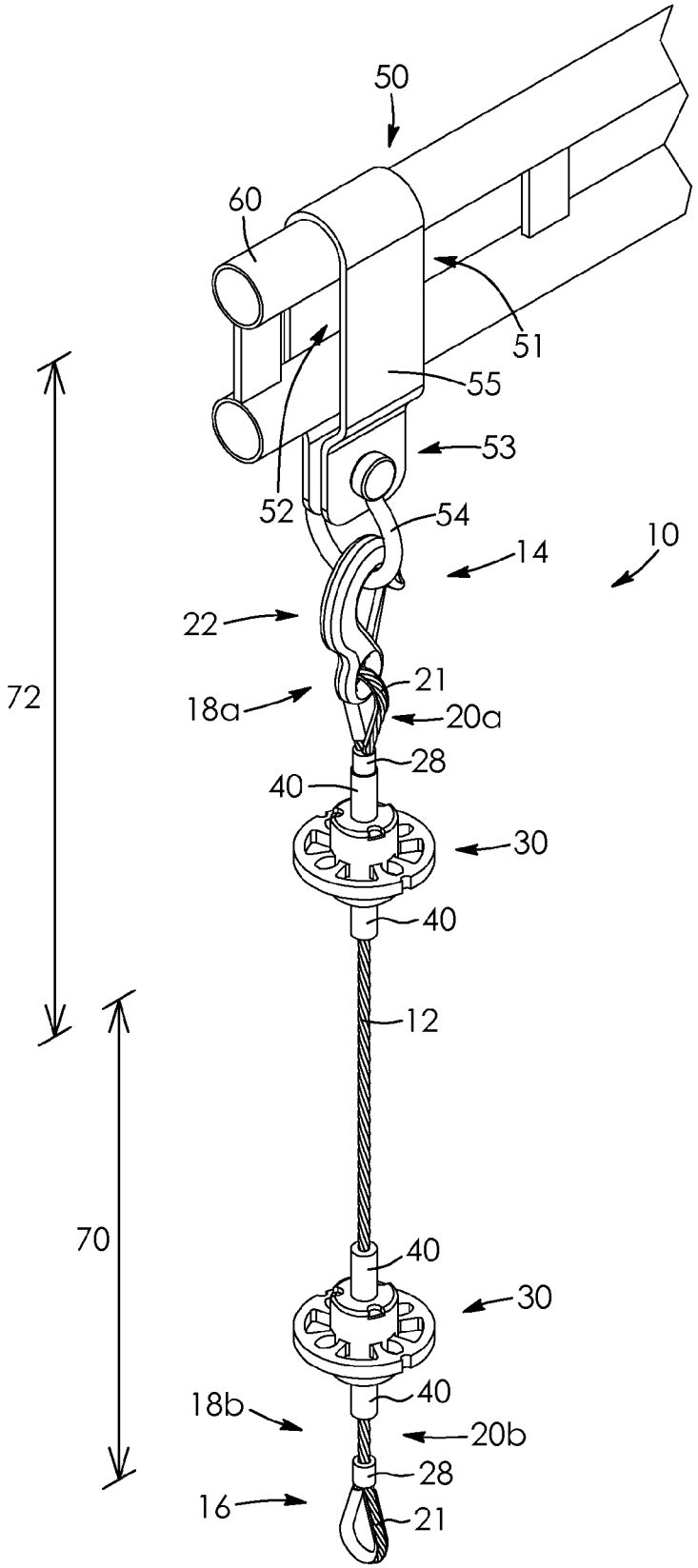
FIG. 4 is a perspective view of a vertical support member as shown in FIG. 1 and, in combination with an adapter, according to an embodiment.
Figure 5:
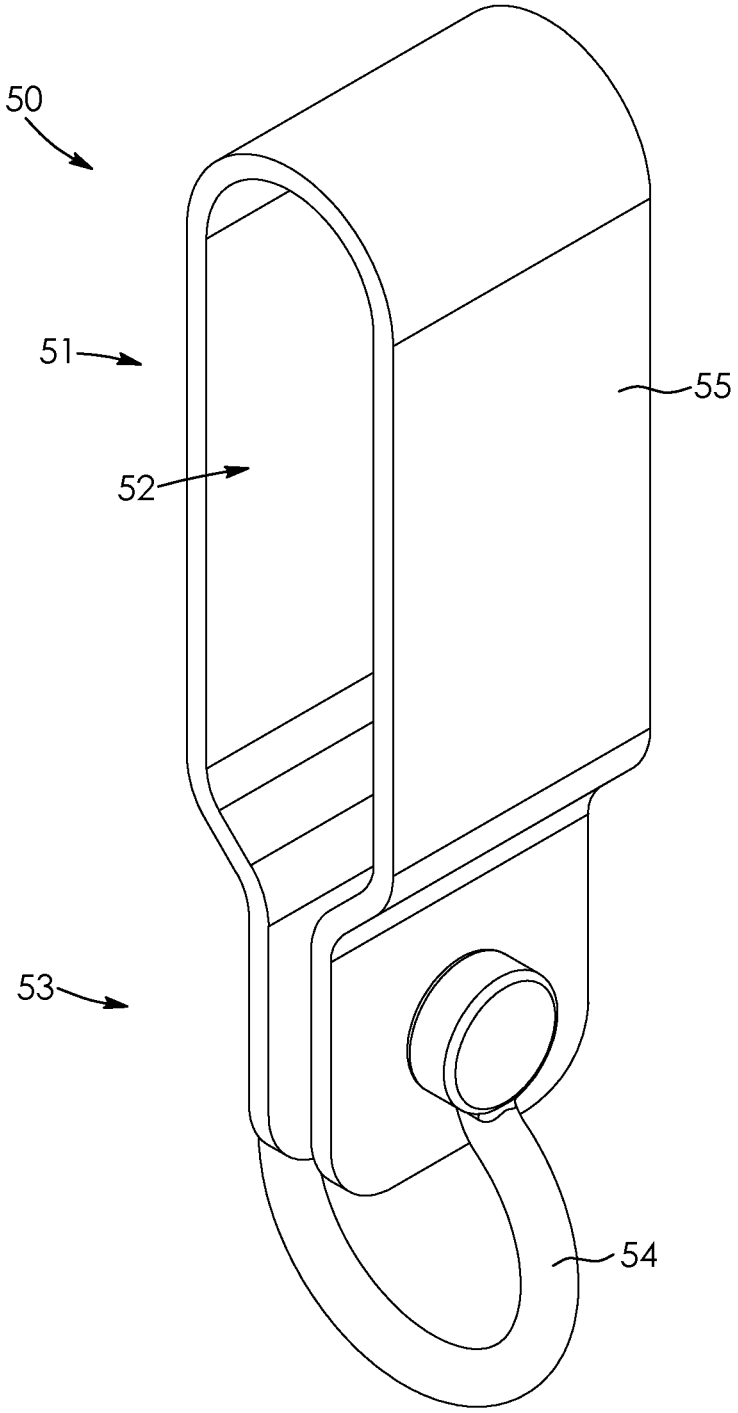
FIG. 5 is a perspective view of the adapter shown in FIG. 4.

Now referring to FIGS. 4 and 5, in an embodiment, one of the vertical support members 10 may be coupled to an adapter 50 configured to engage a substantially horizontally-extending suspension scaffold support 60 by receiving a section of the suspension scaffold support 60 therein. The adapter 50 has an adapter body 55 defining a horizontal support engaging section 51 with a channel 52 sized and shaped to receive the section of the substantially horizontally-extending suspension scaffold support 60 therethrough. The adapter 50 further includes a vertical support engaging section 53, below the horizontal support engaging section 51, including a hanger 54, such as a substantially U-shaped shackle or a clevis fastener. In the embodiment shown, the hanger 54 is secured to the adapter body 55 and extends downwardly therefrom, however, one skilled in the art will understand that in alternative embodiments, the hanger 54 can be configured differently than in the embodiment shown. In another alternative embodiment, the vertical support engaging section 53 can be free of hanger 54, but rather include another type of connecting component configured to connect a vertical support. In still an alternative embodiment, the vertical support member 10 can be directly engaged with the adapter 50.

As can be seen in FIG. 4, the connecting hook 22 of the vertical support member 10 is engageable with the hanger 54. As mentioned above, connection of the vertical support member 10 with the adapter 50 therefore allows the vertical support member 10 to be suspended from a substantially horizontally extending suspension scaffold support 60. One skilled in the art will understand that, once again a plurality of vertical support members 10 can be suspended from a first vertical support member 10 engaged with the adapter 50 in order to reach the above-described cascade configuration.

Figure 2:
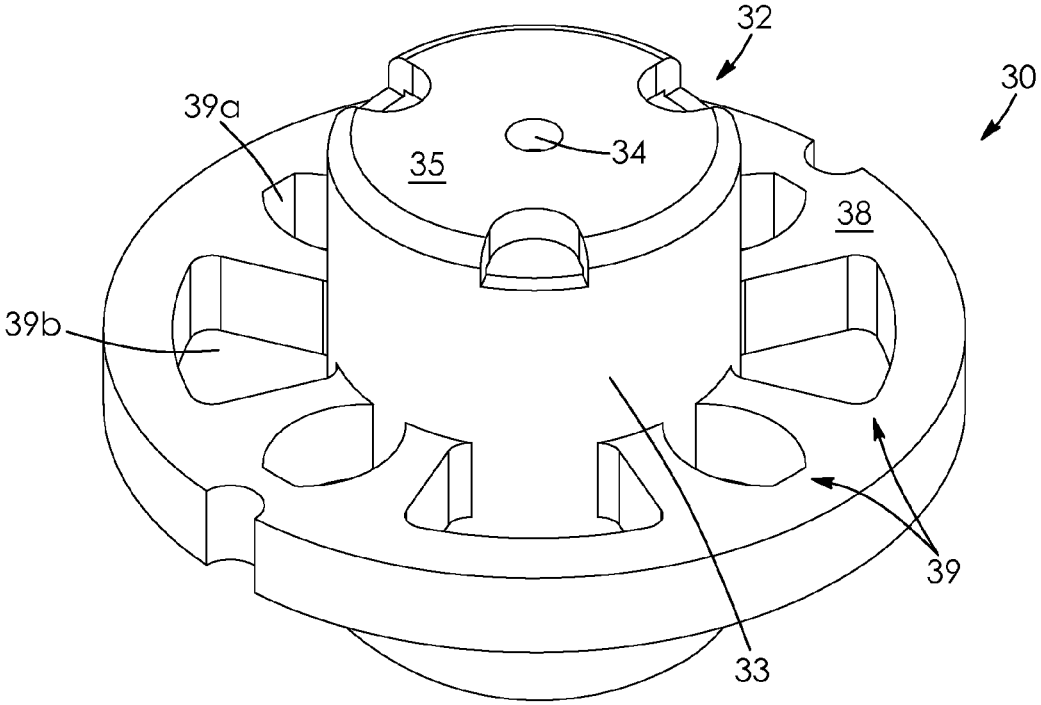
FIG. 2 is a perspective view of a coupling ring of a vertical support member of the vertical support member assembly shown in FIG. 1.
Figures 3, 3A:
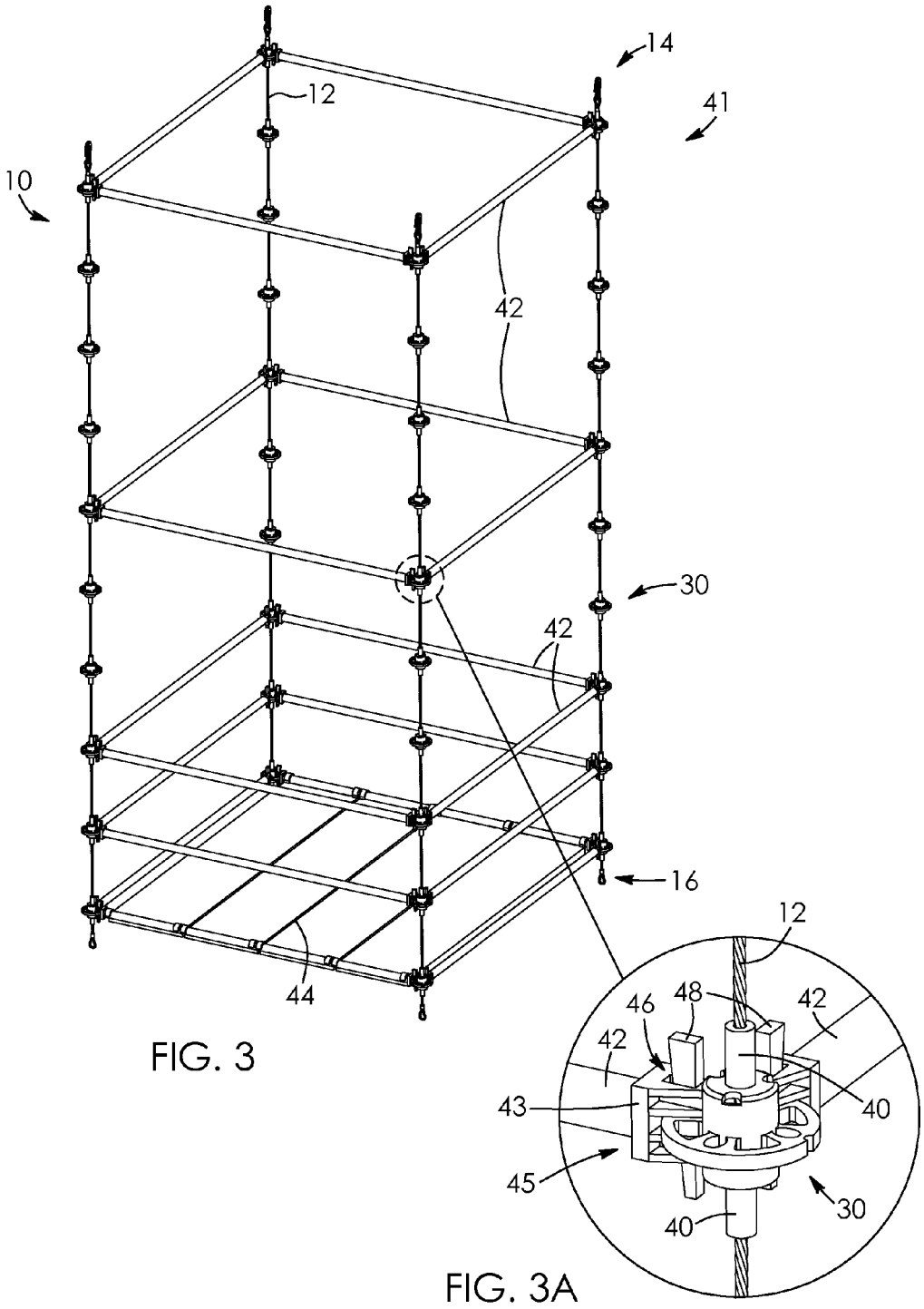
FIG. 3 is a perspective view of a suspended scaffold assembly including a plurality of vertical support members, in accordance with an embodiment.
FIG. 3*a* is a close-up view of a section of the suspended scaffold assembly shown in FIG. 3 showing a coupling ring of one of the vertical support members connected to horizontal members.

Referring to FIGS. 1 to 4, as mentioned above, each vertical support member 10 further includes at least one coupling component and, more particularly, a coupling ring 30 mounted vertically along the suspension cable 12. In the embodiments of FIGS. 1 and 4, the vertical support members 10 have two coupling rings 30 vertically spaced apart along the suspension cable 12. One skilled in the art will understand that, in alternative embodiments, more or fewer coupling rings 30 may be provided along the suspension cable 12. For example, FIG. 3 shows an embodiment of a scaffold unit 41 where the support members 10 have a plurality and, more particularly, ten coupling rings 30 vertically spaced apart along the suspension cable 12.

In embodiments where the support member 10 includes more than two coupling rings 30, the coupling rings 30 can be evenly spaced along the suspension cable 12. In such embodiments, and as can be better seen in FIG. 4, the vertical support members 10 and the adapter 50 may be configured such that a distance 72 between the substantially horizontal suspension scaffold support 60 and an upper one of the coupling rings 30 is about the same as the distance 70 between two consecutive ones of the coupling rings 30. In other words, the length of the upper connecting portion 18*a* and the adapter 50 is substantially similar to the distance 70 between two consecutive coupling rings 30. Moreover, referring to FIG. 1, the upper connecting portion 18*a* and the lower connecting portion 18*b* may also be configured such that the distance 74 between a lower one of the coupling rings 30 of an upper vertical support member 10 and an upper one of the coupling rings 30 of a vertically-consecutive and lower vertical support member 10, suspended from the upper vertical support member 10, is also about the same as the distance 70 between two consecutive coupling rings 30 of the support member 10. In other words, the length of the combined upper connecting portion 18*a* and lower connecting portion 18*b* is substantially similar to the distance 70 between two consecutive coupling rings 30.

For example and without being limitative, two consecutive coupling rings may be vertically spaced apart of a distance 70 of about 500 millimeters.

One skilled in the art will however understand that, in an alternative embodiment, the distance between two consecutive coupling rings 30 can also be different. Hence, one skilled in the art will understand that vertical support members 10 having different suspension cable 12 lengths, amounts of coupling rings 30 and dispositions of coupling rings 30 along the suspension cable 12 can be provided.

With reference to FIG. 2, each coupling ring 30 has a body 32 receiving the suspension cable 12 therethrough. In an embodiment, the body 32 includes a tubular section 33 with a cap cover 35 welded to the tubular section 33, at each end thereof, and a ring portion 38 (or flange). In an embodiment, the tubular section 33 is similar in shape and size to a section of a vertical tube of a conventional ground supported scaffold. Each cap cover 35 has a central aperture 34 for receiving the cable 12 therethrough. In an embodiment (not shown), a plurality of draining holes can be provided for preventing the accumulation of water, such as rain water, inside the tubular section 33. As can be seen, the diameter of the central aperture 34 of the cap cover 35 is smaller than the diameter of the tubular section 33 and closely matches the diameter of the suspension cable 12, such that lateral movement of the tubular section 33 relative to the suspension cable 12 is limited.

One skilled in the art will understand that, in an alternative embodiment, the cap covers 35 can be integral to the tubular section 33 of the coupling ring 30. In another alternative embodiment, the inside of the tubular section 33 can also be full rather than hollow, to the exception of the central aperture 34, thereby resulting in a similar lateral support of the tubular section 33 relative to the suspension cable 12 than what is achieved with the use of the covers 35.

As better seen in FIGS. 1 and 4, in the embodiment shown, each coupling ring 30 is maintained vertically in place by at least one coupling ring support 40 contiguous to the coupling ring 30 and affixed to the suspension cable 12. In an embodiment, each coupling ring support 40 is pressed onto the suspension cable 12, the coupling ring support 40 therefore being connected to the suspension cable 12 by friction fit. One skilled in the art will understand that, in alternative embodiments, other known means or methods, may be used for affixing each coupling ring support 40 to the suspension cable 12.

In an embodiment, coupling ring supports 40 are provided immediately above and below each coupling ring 30, such as to limit vertical movement thereof and support same, as a result of the diameter of the coupling ring supports 40 being greater than the diameter of the central aperture 34 of the cap cover 35 provided at each end of the tubular section 33 of the coupling rings 30. In the case of coupling rings 30 provided close to the ends 14, 16 of the vertical support member 10, the fixation member 28 maintaining the looped end of the suspension cable 12 onto the section of the suspension cable 12 by friction can act as coupling ring support 40 for a corresponding end of the coupling ring 30. In an alternative embodiment, coupling ring supports 40 can be provided only below each coupling ring 30 to maintain the corresponding coupling ring 30 vertically when the vertical support member 10 is configured in a substantially vertical configuration.

In view of the above, one skilled in the art will understand that, in the embodiment shown, each coupling ring 30 is maintained horizontally and vertically relative to the suspension cable 12, but is free to rotate thereabout. In an embodiment, the coupling ring 30 can however be configured to be non-rotatable about the suspension cable 12.

Referring to FIGS. 2 to 3*a*, as mentioned above, each coupling ring 30 further comprises a ring portion 38, such as a rosette, with a set of radially arranged engagement through holes 39. In the embodiment shown, the ring portion 38 is integral with the tubular section 33, but one skilled in the art will understand that, in an alternative embodiment, the ring portion 38 and the tubular section 33 can be connected by known means and methods, such as, welding, soldering or the like. The ring portion 38 of the coupling rings 30 is designed to connect horizontal members 42 to the vertical support members 10, in order to form a suspended scaffold unit 41. One skilled in the art will understand that the horizontal member 42 may include ledgers, guardrails, diagonal braces and the like. It will be understood that, in an embodiment, supporting elements 44, such as planks, platform units and/or other footing components may be subsequently laid onto the horizontal members 42 to provide supports for user to step onto.

In the embodiment shown, the ring portion 38 of the coupling ring 30 is a conventional rosette with four small through holes 39*a* designed for right-angled connections of conventional horizontal members, such as ledgers, and four larger through holes 39*b* designed for non-right-angled connections of other conventional horizontal members, such as braces. As is known in the art, conventional horizontal members 42 usually have a head 43 and a substantially horizontal slot 45. The horizontal slot 45 divides the horizontal members 42 into an upper section and a lower section, each having a substantially vertical through hole 46. When connection between a horizontal member 42 and the vertical support member 10 is desired, the head 43 of the horizontal member 42 is positioned with respect to the ring portion 38 of a corresponding connecting ring 30 such that the ring portion 38 is engaged in the substantially horizontal slot 45 of the head 43 such that the upper section and the lower section are respectively positioned above and below the ring portion 38 and the substantially vertical through holes 46 of the head 43 are aligned with the small holes 39*a* thereof. In an embodiment, a wedge 48 is subsequently inserted into each substantially vertical through hole 46 in order to couple the horizontal member 42 to the ring portion 38 of the connecting ring 30 of a vertical support member 10. In view of the above, one skilled in the art will understand that, in an embodiment, the vertical support members 10 can be used in combination with conventional scaffold equipment with conventional rosettes as described above.

One skilled in the art will understand that, in an alternative configuration, the ring portion 38 of the coupling ring 30 can have a different set of radially arranged engagement through holes 39 than the conventional rosette as described above. Indeed, it will be understood that any configuration which allows the secure coupling of horizontal members thereto may be used.

Now referring to FIG. 3, it will be understood that the above described vertical support members 10, may be used as part of a suspended scaffold assembly where, as mentioned above, a plurality of substantially parallel vertical support members 10 can be connected by a plurality of horizontal members 42 to form a scaffold unit 41 suspended from an upper suspension scaffold support 60. Diagonal braces (not shown) can be additionally connected between the vertical support members 10 in order to provide a sturdier scaffold unit 41. Moreover, as mentioned above, in an embodiment, supporting elements 44, such as planks, platform units and/or other footing components, may be laid onto the horizontal members 42 acting as ledgers, in order to provide support at different levels for users to step onto. It will be understood that, horizontal members 42 positioned between the supporting elements 44 can act as guardrails.

Once again, in an embodiment (not shown), the scaffold unit 41 can include a plurality of substantially parallel vertical support member assemblies 11, where each one of the vertical support member assemblies 10 includes two or more vertically adjacent vertical support members 10 engaged to one another in the above-described cascade configuration.

In view of the above, a method for mounting a suspended scaffold assembly using the above described vertical support members 10 will now be described. The method comprises a first step of suspending a plurality of vertical support members 10 from an upper scaffold support 60. The vertical support members 10 are spaced apart from one another and each include at least one coupling ring 30 mounted to the suspension cable 12, as described above. The method comprises the second step of connecting horizontal members 42 between the spaced-apart vertical support members 10. As can be understood by the above description, each horizontal member 42 is connected at its two ends to a corresponding coupling ring 30 of a respective one of the vertical support members 10.

In an embodiment, the method also includes the steps of engaging adapters 50 with the upper scaffold support 60 and engaging each one of the plurality of spaced-apart vertical support members 10 with a corresponding one of the adapters 50 such as to suspend the vertical support members 10 from the upper scaffold support 60.

In an embodiment, supplemental vertical support members 10 may also be suspended from vertical support members 10 positioned above by engaging at least one vertical support member 10 with at least one of the plurality of spaced-apart vertical support members engaged with the suspension scaffold support, in the above-described cascade configuration, thereby forming vertical support member assemblies 11 as described above. Once again, each one of the vertical support members 10 includes at least one coupling ring 30, as described above. In such an embodiment, a plurality of horizontal members 42 are connected between the supplemental vertical support members 10 in the manner described above.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A suspended scaffold assembly for mounting a scaffold, the suspended scaffold assembly comprising:

a plurality of horizontally-spaced-apart vertical support members, each one of the horizontally-spaced-apart vertical support members comprising a suspension cable with at least one coupling ring longitudinally fixedly attached thereto, the at least one coupling ring comprising a central section with cap covers at opposed ends and a surrounding ring portion extending radially from the central section, the surrounding ring portion having a set of radially arranged engagement through holes, the cap covers having an aperture defined therein, the suspension cable extending through the central section and through the cap cover apertures; and at least one horizontal member removably connectable to a respective one of the at least one coupling ring of two spaced-apart ones of the plurality of vertical support members.

2. The suspended scaffold assembly of claim 1, wherein each one of the plurality of vertical support members further comprises at least one coupling ring support coupled with a respective one of the at least one coupling ring and affixed to the suspension cable, the at least one coupling ring support maintaining the respective one of the at least one coupling ring vertically in place.

3. The suspended scaffold assembly of claim 1, wherein the at least one coupling ring of each one of the plurality of vertical support members comprises two coupling ring supports affixed to the suspension cable, a first one of the coupling ring supports being affixed to the suspension cable above the central section and a second one of the coupling ring supports being affixed to the suspension cable below the central section.

4. The suspended scaffold assembly of claim 1, wherein a diameter of the central section is larger than a diameter of the suspension cable extending therein, the central section is tubular and the cap cover apertures are central apertures.

5. The suspended scaffold assembly of claim 4, wherein the suspension cable of each one of the plurality of vertical support members comprises at least one connecting loop at an end thereof, and wherein at least one of the plurality of vertical support members further comprises a connecting hook engaged with an upper one of the at least one connecting loop.

6. The suspended scaffold assembly of claim 1, further comprising at least one vertical support member assembly comprising at least two vertical support members of the plurality of vertical support members engaged together in a cascade configuration.

7. A kit for mounting a suspended scaffold assembly comprising:

a plurality of vertical support members, each one of the vertical support members comprising a suspension cable with at least one coupling ring longitudinally fixedly attached thereto, the at least one coupling ring comprising a central section with cap covers at opposed ends and a surrounding ring portion extending radially from the central section, the surrounding ring portion having a set of radially arranged engagement through holes, the cap covers having an aperture defined therein, the suspension cable extending through the central section and through the cap cover apertures; and at least one horizontal member having two distal ends removably connectable to a respective one of the at least one coupling ring of a pair of adjacent vertical support members.

8. The kit for mounting a suspended scaffold assembly of claim 7, further comprising a plurality of adapters having a horizontal support engaging section engageable with a section of a substantially horizontally extending suspension scaffold support and a vertical support engaging section engageable with a corresponding one of the plurality of vertical support members.

9. The kit for mounting a suspended scaffold assembly of claim 7, wherein each one of the plurality of vertical support members further comprising at least one coupling ring support coupled with a respective one of the at least one coupling ring and affixed to the suspension cable, the at least one coupling ring support maintaining the respective one of the at least one coupling ring vertically in place.

10. The kit for mounting a suspended scaffold assembly of claim 7, wherein a diameter of the central section is larger than a diameter of the suspension cable extending therein, the central section is tubular and the cap cover apertures are central apertures.

11. The kit for mounting a suspended scaffold assembly of claim 7, wherein each one of the plurality of vertical support members comprises at least one connecting portion including a connecting loop formed by the suspension cable.

12. The kit for mounting a suspended scaffold assembly of claim 11, wherein at least one of the at least one connecting portion further comprises a connecting hook engaged with the connecting loop.

13. The kit for mounting a suspended scaffold assembly of claim 7, wherein at least two of the plurality of vertical support members are engageable in a cascade configuration to define a vertical support member assembly.

14. The kit for mounting a suspended scaffold assembly of claim 7, wherein the suspension cable of each one of the plurality of vertical support members comprises a flexible cable.

15. The kit for mounting a suspended scaffold assembly of claim 7, wherein the at least one coupling ring of each one of the plurality of vertical support members is rotatably mounted about the suspension cable.

16. A method for mounting a suspended scaffold assembly using the kit of claim 7, the method comprising the steps of:

suspending the plurality of vertical support members from a suspension scaffold support in a spaced-apart configuration; and connecting the at least one horizontal member between two of the plurality of horizontally spaced-apart vertical support members, each one of the two distal ends of the at least one horizontal member being connected to one of the at least one coupling ring of respective ones of the plurality of vertical support members.

17. The method for mounting a suspended scaffold assembly of claim 16, wherein the step of suspending the plurality of vertical support members further comprises the steps of engaging adapters with the suspension scaffold support and engaging each one of the plurality of spaced-apart vertical support members with a corresponding one of the adapters.

* * * * *